US007300355B1

(12) United States Patent
Hense

(10) Patent No.: US 7,300,355 B1
(45) Date of Patent: Nov. 27, 2007

(54) TANDEM SWING

(76) Inventor: Dannie Hense, 342 Private Dr., Sugar Grove, NC (US) 28679

( * ) Notice: Subject to any disclaimer, the term of this patent is extended or adjusted under 35 U.S.C. 154(b) by 0 days.

(21) Appl. No.: 11/540,425

(22) Filed: Sep. 29, 2006

(51) Int. Cl.
*A63G 9/12* (2006.01)

(52) U.S. Cl. ..... 472/125; 472/118

(58) Field of Classification Search ..... 472/118–125
See application file for complete search history.

(56) References Cited

U.S. PATENT DOCUMENTS 3,615,119 A 10/1971 Irwin
3,663,016 A 5/1972 Morris
4,289,310 A * 9/1981 Weakly ..... 472/118
4,417,725 A 11/1983 Van Horn
D340,275 S 10/1993 Haun
5,393,268 A * 2/1995 Cunard et al. ..... 472/120
5,766,084 A 6/1998 Smith
6,585,319 B2 7/2003 Tseng

* cited by examiner

*Primary Examiner*—Kien Nguyen
(74) *Attorney, Agent, or Firm*—Lawrence J. Gibney, Jr.

(57) ABSTRACT

This is a swing by which two people can enjoy a swing without risk of colliding with each other on the swing. Because this device employs a spreader bar two people can swing at the same time and not collide

1 Claim, 3 Drawing Sheets

TANDEM SWING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to entertainment or playing, specifically using a swing that is commonly found in the prior art. The present application attempts to make the swing a dual swing for two people to swing at the same time, both in the same direction or in independent directions while connected to the same swing structure.

B. Prior Art

There are many other prior art references to swings and playground equipment in general and in particular tandem swings. A representative example can be found at Morris, U.S. Pat. No. 3,663,616. This, however, is different in structure in that this functions by employing a pendulum type operation.

Another example in the prior art can be found at Vanhorn, U.S. Pat. No. 4,417,725, which is secured to a fixed structure. A pair of ropes or cables hangs from the fixed structure and are attached to the seats of the swing. The disadvantage of this is that there is no spreader bar as contemplated in this case and the device would not be suitable for play for that reason due to the possibility of collisions which may occur as the persons attempt to swing.

BRIEF SUMMARY OF THE INVENTION

This is a device by which an individual can make the standard swing into a tandem swing. Standard cable or ropes are used as in most swings and they will be used with this device.

A cable, chain or rope is suspended from a structure, which should be sturdy enough to support the weight of two people on the device. At a predetermined point the cable, chain or rope is separated into two shorter support cables, chains or ropes and each shorter support chain is secured to one side of a spreader bar. Another piece of chain, rope or cable is secured to the spreader bar and is used to suspend the seat from the spreader bar.

The use of the spreader bar allows the seats to be separated enough to allow two individuals to swing and at the same time to reduce the risk of collision while swinging. The length of cable, chain or rope that extends from the spreader bar is again separated and secures the seat at two points. This method of securing the swing seat is commonly found in the prior art.

The seat is secured at two points to one end of the chain, rope or cable that is secured to the spreader bar. The material that is used for the seat may be a variety of materials that are commonly found in swing seat construction. Plastic tubing may also cover the chain, rope or cable for the comfort of the user.

It is an object of this device to make a device that will allow two people to swing at the same time and prevent collisions during the swinging operation.

DETAILED DESCRIPTION OF THE EMBODIMENTS

Swings have been around for a number of years. This device seeks to maximize the efficiency and enjoyment of a swing by operating as a tandem swing so that two people can swing at the same time on the same swing structure.

Figure 1:
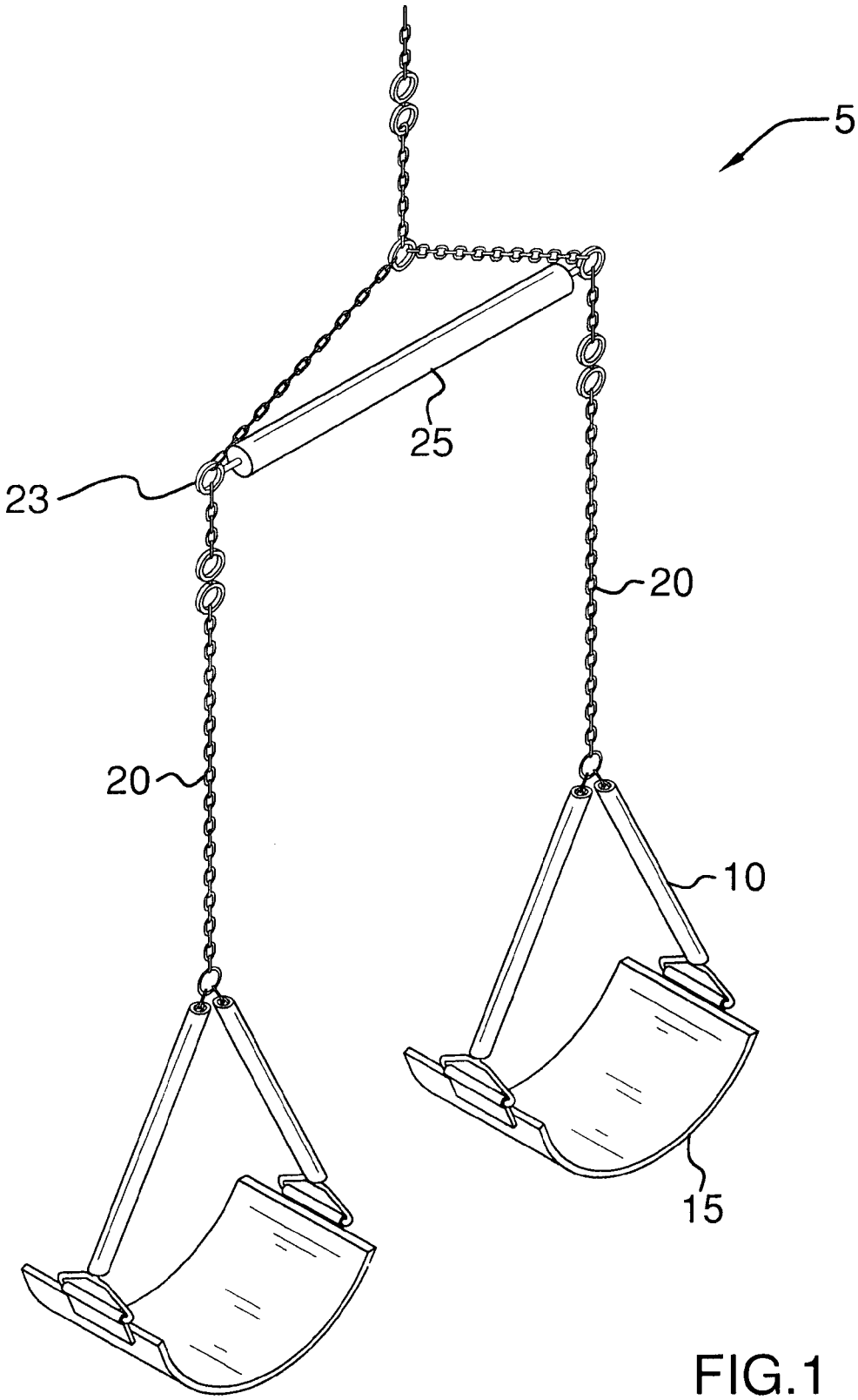
FIG. 1 is an isometric view of the device.
Figure 2:
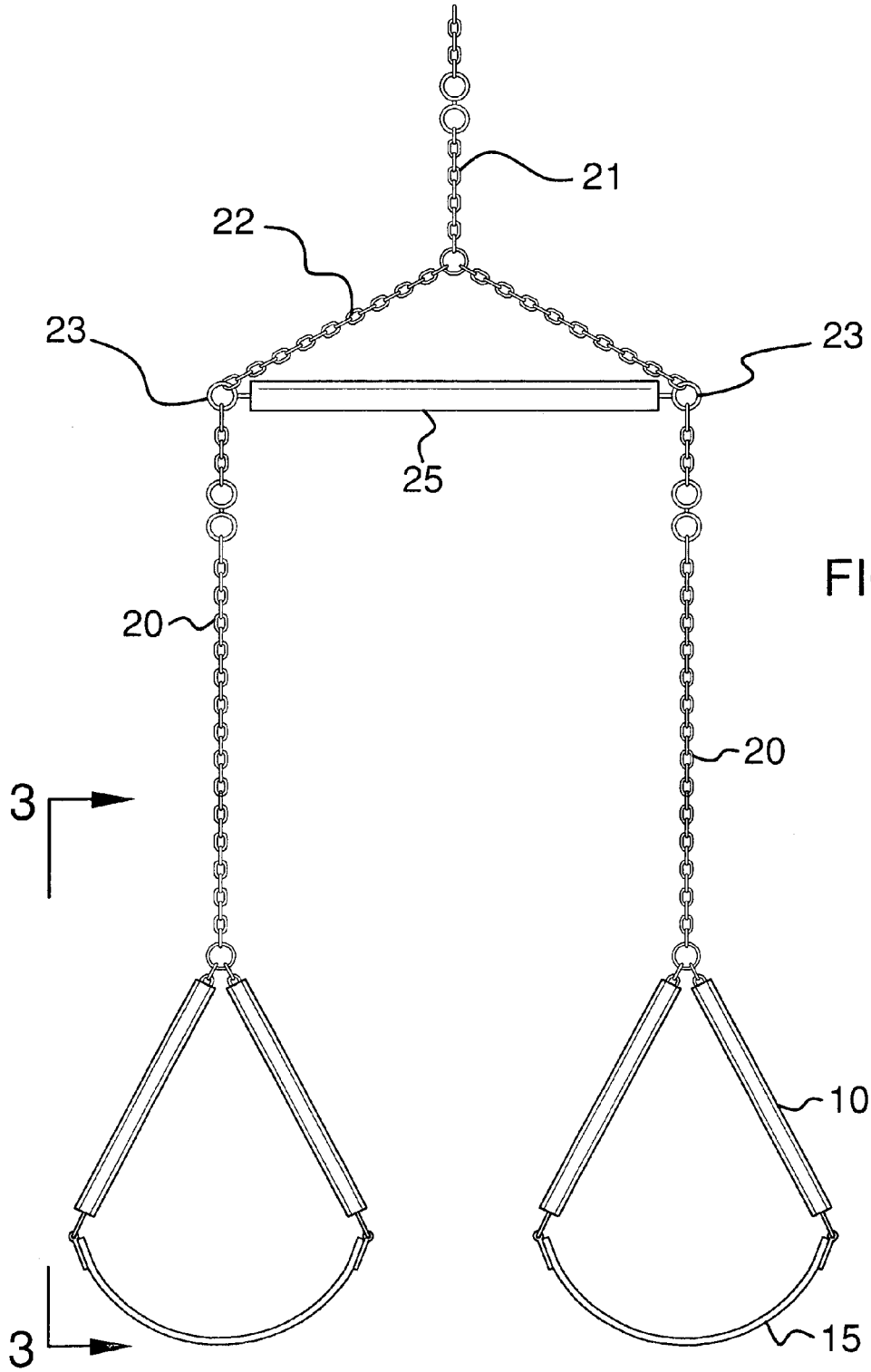
FIG. 2 is a front view.
Figure 3:
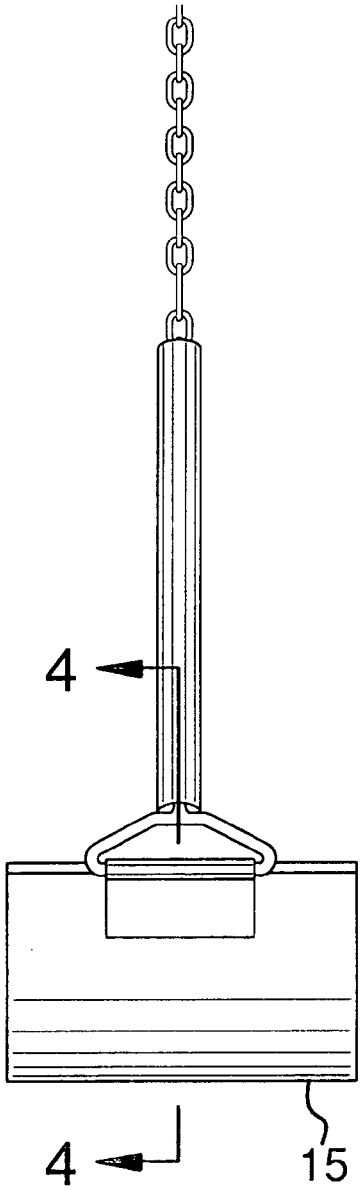
FIG. 3 is a side view.
Figure 4:
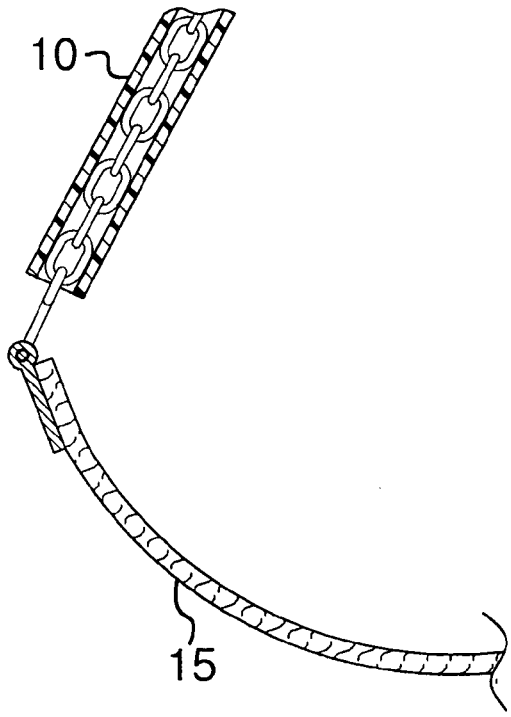
FIG. 4 is a view according to line 4-4 on FIG. 3.

A means to suspend a swing such as a chain, rope or cable 21 is provided to suspend the swing from a fixed structure. At a predetermined point from the main support chain 21, rope or cable, the chain, rope or cable is separated into two sections by a joiner means such as a ring. One end of the main support chain 21 is attached the ring and supports a set of secondary chain 22, rope or cable. The other end of each of the secondary chains 22 is secured to a spreader bar 25. FIGS. 1,2

A tertiary piece of chain 20, rope or cable is secured to the spreader bar 25 at one end and to a chain which support the seat 19 at the other. Two tertiary chains are used to support the two seats. Two seats can be placed on this particular device as a result of the use of the spreader bar 25. The seats will be flexible 15 for maximum comfort. A variety of materials that is commonly used to construct swing seats may be used and the specific material is not being claimed.

Plastic tubing 10 around the tertiary chain 20 or rope between the points of contact with the seat and the chain, rope or cable from the spreader bar 25 will be provided for the comfort of the user.

The device will operate as a normal swing, but it does not have the disadvantage of the prior art in that it will not tilt excessively to one side or the other.

The chair or seat 15 is secured to a chain, using a series of chains and an attachment means on the seat itself. The attachment means as well as chains and ropes to be used as swings are commonly found in the prior art, and they are not specifically being claimed.

The inventor claims:

1. A tandem swing, which is comprised of:

a. a main support chain;

wherein the main support chain is secured to a fixed structure;

wherein the main support chain has a first end and a second end;

wherein the main support chain is secured at the first end to a permanent structure;

wherein the main support chain is secured to a joinder means at the second end;

b. secondary support chains;

wherein the secondary support chains have a first end and a second end;

wherein the first end is secured to the joinder means;

wherein the second end is secured to a spreader bar;

c. spreader bar;

wherein the spreader bar is a predetermined length;

wherein a spreader bar is employed to separate the secondary support chains;

wherein the spreader bar is employed to minimize collisions;

wherein a plurality of tertiary chains is secured to the spreader bar;

d. tertiary chains;

wherein a plurality of tertiary chains support the seats;

wherein one tertiary chain is used for each seat;

said tertiary chains operate independently of each other;

e. seats;

wherein a plurality of seats is provided;

said seat is designed to accommodate a single human person;

wherein each of the seats is secured to the tertiary chains;

said seats are allowed to move independently from each other.

* * * * *